US006357677B1

(12) United States Patent
Ren et al.

(10) Patent No.: US 6,357,677 B1
(45) Date of Patent: Mar. 19, 2002

(54) FUEL INJECTION VALVE WITH MULTIPLE NOZZLE PLATES

(75) Inventors: Wei-Min Ren, Yorktown; David P. Wieczorek, Seaford, both of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/538,730

(22) Filed: Mar. 30, 2000

Related U.S. Application Data

(60) Provisional application No. 60/159,229, filed on Oct. 13, 1999.

(51) Int. Cl.[7] ..... F02M 51/00
(52) U.S. Cl. ..... 239/585.4; 239/596
(58) Field of Search ..... 239/585.4, 596

(56) References Cited

U.S. PATENT DOCUMENTS

| | | | | |
|---|---|---|---|---|
| 4,903,898 A | | 2/1990 | Kind | 239/533.12 |
| 4,923,169 A | | 5/1990 | Grieb et al. | 251/118 |
| 5,344,081 A | | 9/1994 | Wakeman | 239/585.4 |
| 5,383,597 A | | 1/1995 | Sooriakumar et al. | 239/5 |
| 5,449,114 A | | 9/1995 | Wells et al. | 239/5 |
| 5,484,108 A | | 1/1996 | Nally | 239/553.3 |
| 5,516,047 A | | 5/1996 | Kubach et al. | 239/585.5 |
| 5,553,789 A | | 9/1996 | Findler et al. | 239/548 |
| 5,553,790 A | | 9/1996 | Findler et al. | 239/585.1 |
| 5,662,277 A | * | 9/1997 | Taubitz et al. | 239/585.4 |
| 5,685,491 A | | 11/1997 | Marks et al. | 239/533.12 |
| 5,716,001 A | | 2/1998 | Wakemann et al. | 239/74 |
| 5,762,272 A | | 6/1998 | Tani et al. | 239/543 |
| 5,765,750 A | | 6/1998 | Pace et al. | 239/5 |
| 5,766,441 A | | 6/1998 | Arndt et al. | 205/170 |
| 5,899,390 A | | 5/1999 | Arndt et al. | 239/553 |
| 5,921,473 A | | 7/1999 | Romann | 239/533.2 |
| 5,924,634 A | | 7/1999 | Arndt et al. | 239/553 |
| 5,924,674 A | | 7/1999 | Hahn et al. | 251/129.01 |
| 6,135,360 A | * | 10/2000 | Ren et al. | 239/585.4 X |
| 6,168,099 B1 | * | 1/2001 | Hopf et al. | 239/596 |

FOREIGN PATENT DOCUMENTS

| | | |
|---|---|---|
| DE | 4025941 A1 | 2/1992 |
| EP | 0 314 285 A1 | 5/1989 |

* cited by examiner

*Primary Examiner*—Lesley D. Morris

(57) ABSTRACT

A metering assembly for a fuel injector having multiple orifice plates is disclosed. The metering assembly includes a valve body, a seat, a needle and a multi-layer orifice plate assembly. The valve body has an inlet, an outlet and a longitudinal axis extending therethrough. The seat is disposed proximate the outlet and includes a passage having a sealing surface and an orifice. The needle is reciprocally located within the housing along the longitudinal axis between a first position wherein the needle is displaced from the seat, allowing fuel flow past the needle, and a second position wherein the needle is biased against the seat, precluding fuel flow past the needle. The multi-layer orifice plate assembly is located at the housing outlet and includes a first orifice plate having a plurality of first openings extending therethrough. The orifice plate assembly further includes a second orifice plate having a plurality of second openings extending therethrough. The plurality of first openings and the plurality of second openings are fluidly connected by at least one channel. A method of accelerating fuel through the injector is also disclosed.

22 Claims, 5 Drawing Sheets

FUEL INJECTION VALVE WITH MULTIPLE NOZZLE PLATES

CROSS REFERENCE TO RELATED APPLICATIONS

This application claims the benefit of U.S. Provisional Application No. 60/159,229, filed Oct. 13, 1999.

FIELD OF THE INVENTION

The invention relates to fuel injectors, and more particularly, to fuel injectors having multiple interchangeable nozzle plates.

BACKGROUND OF THE INVENTION

Fuel injectors are commonly employed in internal combustion engines to provide precise metering of fuel into each combustion chamber. Additionally, each fuel injector atomizes the fuel during injection into the respective combustion chamber, breaking the fuel into a large number of very small particles, increasing the surface area of the fuel being injected and allowing the oxidizer, typically ambient air, to more thoroughly mix with the fuel prior to combustion. The precise metering and atomization of the fuel reduces combustion emissions and increases the fuel efficiency of the engine.

An electromagnetic fuel injector typically utilizes a solenoid assembly to supply an actuating force to a fuel metering valve. Typically, the fuel metering valve is a plunger style needle valve which reciprocates between a closed position, when the needle is seated in a seat to prevent fuel from escaping through a metering orifice into the combustion chamber, and an open position, where the needle is lifted from the seat, allowing fuel to discharge through the metering orifice and into the combustion chamber.

Typically, fuel injectors employ a metering nozzle or orifice comprised of a single orifice plate with a plurality of orifice openings extending therethrough through which pressurized fuel is introduced into the combustion chamber. Modifications to these metering orifices include multiple orifice plates stacked upon each other to provide alternate pathways for the fuel immediately prior to injection into the combustion chamber. These alternate pathways increase the turbulence of the fuel flow, providing greater atomization of the fuel as the fuel passes through the orifice openings, providing for enhanced mixture of the fuel with combustion air which reduces unwanted exhaust emissions and improves the fuel efficiency of the engine.

Typically, injectors with multiple orifice plates include a first top orifice plate having a plurality of openings extending therethrough, a bottom orifice plate having a like plurality of openings extending therethrough, and an open space between the top orifice plate and the bottom orifice plate for redirecting the fuel flow between the outlet of the top orifice plate orifice openings and the inlet of the bottom orifice plate orifice openings. Additionally, the space between the top and bottom orifice plates generally includes walls or other obstructions which tend to direct the fuel from the outlet of the top orifice plate to a particular orifice opening in the bottom orifice plate, creating a relatively laminar flow and precluding a fuel stream from one top orifice plate orifice opening from impinging into the stream from another top orifice plate orifice opening. Additionally, fuel injectors with multiple orifice plates require the orifice plates to be fused or electroplated together, precluding the ability to interchange orifice plates to obtain different fuel flow patterns.

It would be beneficial to develop a fuel injector having a metering orifice with multiple orifice plates which includes a fully open space between top and bottom orifice plates and which also allows interchangeability of different orifice plates to produce different flow stream patterns.

SUMMARY OF THE INVENTION

Briefly, the present invention provides a fuel injector comprising a housing, a seat, a needle, and a multi-layer orifice plate assembly. The housing has an inlet, an outlet and a longitudinal axis extending therethrough. The seat is disposed proximate the outlet and includes a sealing surface and a passage extending therethrough. The needle is reciprocally located within the housing along the longitudinal axis between a first position wherein the needle is displaced from the seat, allowing fuel flow past the needle, and a second position wherein the needle is biased against the seat, precluding fuel flow past the needle. The multi-layer orifice plate assembly is located at the housing outlet. The orifice plate assembly includes a first orifice plate having a plurality of first openings extending therethrough. The orifice plate assembly also includes a second orifice plate having a plurality of second openings extending therethrough. The plurality of first openings and the plurality of second openings are fluidly connected by at least one channel.

The present invention also provides a fuel injector comprising a housing, a seat, a needle and a multi-layer orifice plate assembly. The housing has an inlet, an outlet and a longitudinal axis extending therethrough. The seat is disposed proximate the outlet and includes a sealing surface and a passage extending therethrough. The needle is reciprocally located within the housing along the longitudinal axis between a first position wherein the needle is displaced from the seat, allowing fuel flow past the needle, and a second position wherein the needle is biased against the seat, precluding fuel flow past the needle. The multi-layer orifice plate assembly is located at the housing outlet and includes a first orifice plate having a plurality of first openings extending therethrough. The plurality of first openings are each spaced a first predetermined radial distance from the longitudinal axis. The orifice plate assembly further includes a second orifice plate having a plurality of second openings extending therethrough. The plurality of second openings are each spaced a second predetermined radial distance from the longitudinal axis such that the second predetermined radial distance is less than the first predetermined radial distance. The orifice plate assembly further includes a third orifice plate located between the first orifice plate and the second orifice plate. The third orifice plate includes a third orifice plate central opening extending therethrough along the longitudinal axis such that the third orifice plate central opening fluidly connects the plurality of first orifice plate openings and the plurality of second orifice plate openings.

The present invention also provides a method of accelerating a velocity of fuel through a fuel injector having a longitudinal axis and a multi-layer orifice plate. The method comprises the steps of directing the fuel through openings in a top orifice plate; directing the fuel into a space between the top orifice plate and a bottom orifice plate; and directing the fuel through openings in the bottom orifice plate, the openings in the bottom orifice plate being radially closer to the longitudinal axis than the openings in the top orifice plate.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain features of the invention. In the drawings.

DETAILED DESCRIPTION OF THE PREFERRED EMBODIMENTS

Figure 1:
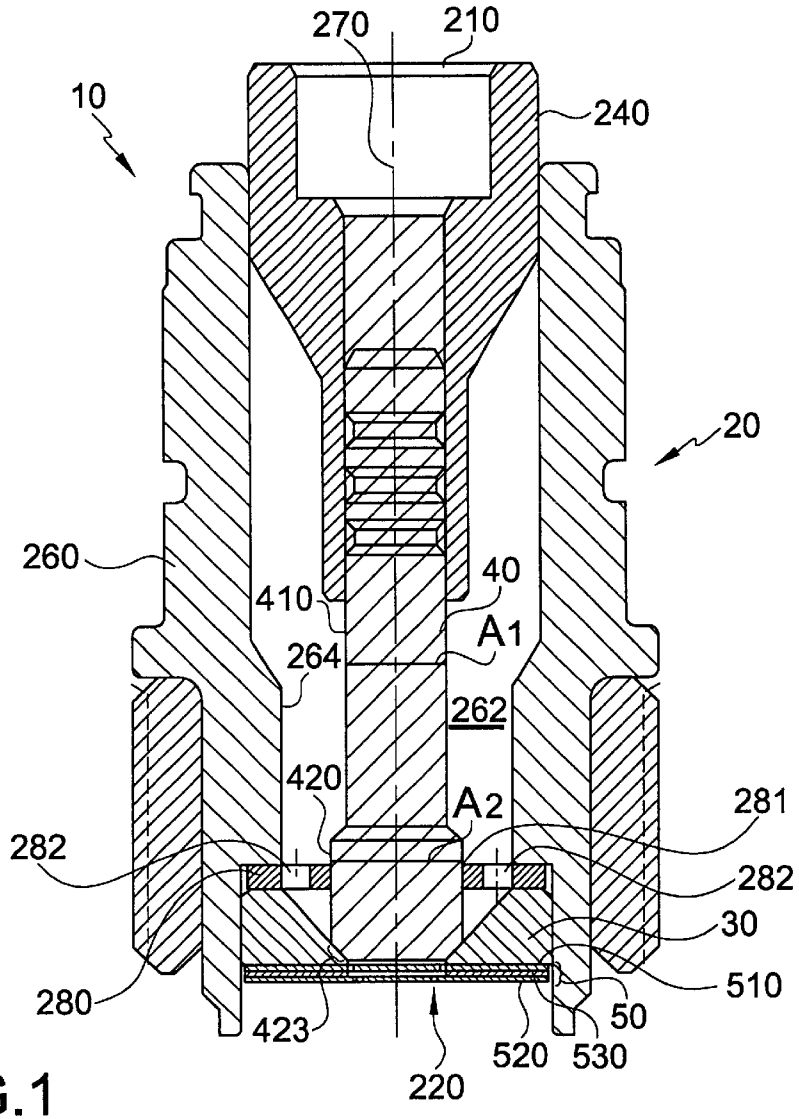
FIG. 1 is a side view, in section, of a discharge end of a fuel injector of the present invention incorporating a multiple orifice plate configuration according to a first embodiment of the present invention, with a needle in a closed position.
Figure 2:
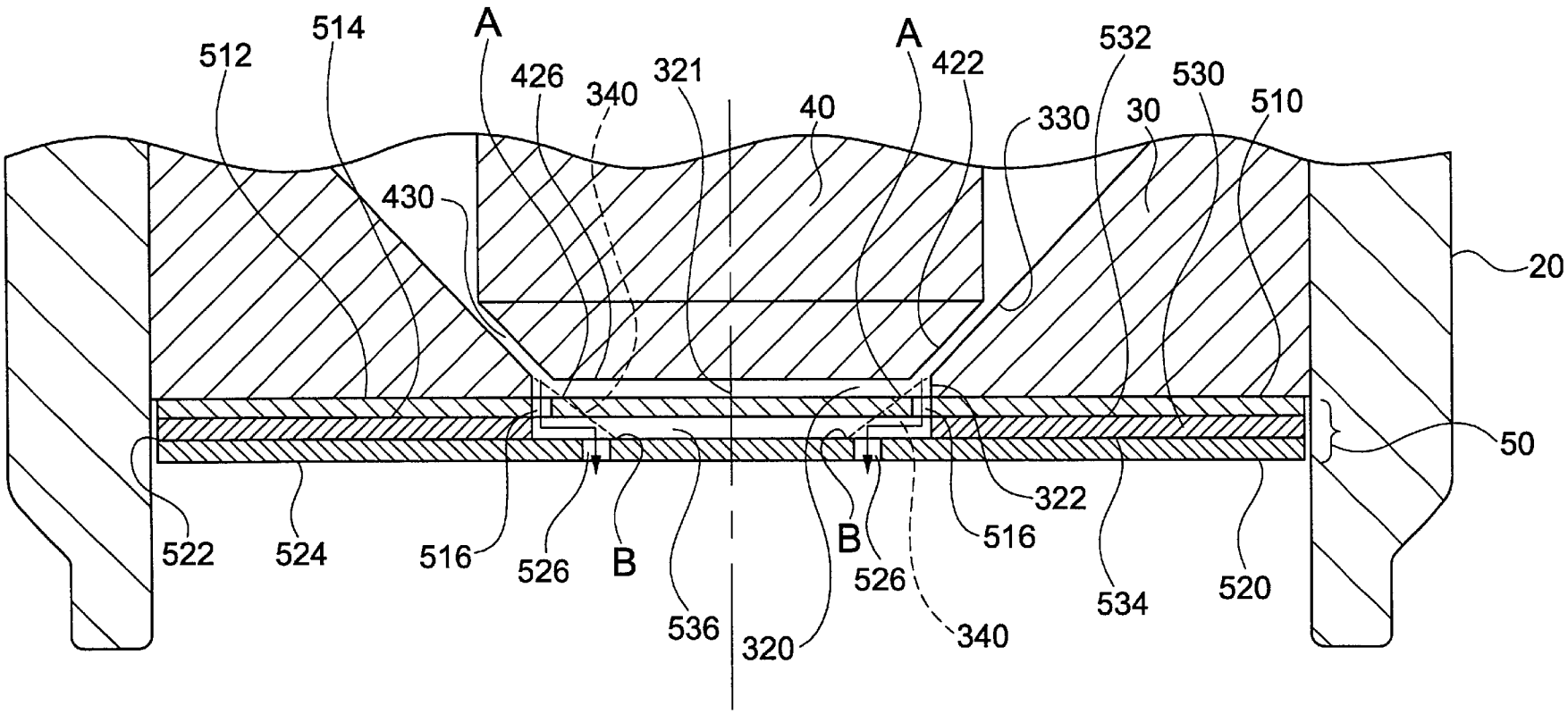
FIG. 2 is an enlarged view of the discharge end of the needle of FIG. 1, with the needle in an open position.

In the drawings, like numerals are used to indicate like elements throughout. A first preferred embodiment, shown in FIGS. 1 and 2, is a fuel metering assembly 10 for use in a fuel injection system of an internal combustion engine. The metering assembly 10 includes a valve body 20, a seat 30, a needle 40, and a generally planar composite nozzle or orifice plate assembly 50. Details of the operation of the fuel metering assembly 10 in relation to the operation of the internal combustion engine (not shown) are well known and will not be described in detail herein, except as the operation relates to the preferred embodiments. Although the preferred embodiments are generally directed to injector valves for internal combustion engines, those skilled in the art will recognize from present disclosure that the preferred embodiments can be adapted for other applications in which precise metering of fluids is desired or required.

The valve body 20 has an upstream or inlet end 210 and a downstream or outlet end 220. The valve body 20 includes an armature 240 as shown in FIG. 1. The words "upstream" and "downstream" designate flow directions in the drawings to which reference is made. The upstream side is toward the top of each drawing and the downstream side is toward the bottom of each drawing. The needle 40 is connected to the armature 240. An electromagnetic coil (not shown) located above the valve body 20 is selectively energized and deenergized to reciprocate the armature 240 and the needle 40 within the valve body 20. The valve body 20 further includes a body 260 which includes a housing chamber 262. The housing chamber 262 extends through a central longitudinal portion of the valve body 20 along a longitudinal axis 270 extending therethrough and is formed by an interior housing wall 264. A needle guide 280 having a central needle guide opening 281 and a plurality of radially spaced fuel flow openings 282 is located within the housing chamber 262 proximate to the downstream end 220 of the valve body 20. The needle guide assists in maintaining reciprocation of the needle 40 along the longitudinal axis 270.

The seat 30 is located within the housing chamber 262 proximate to the outlet end 220 between the needle guide 280 and the discharge ends 220. The seat 30 includes a passage or orifice 320 which extends through the seat 30 generally along the longitudinal axis 270 of the valve body 20 and is formed by a generally cylindrical wall 322. Preferably, a center 321 of the orifice 320 is on the longitudinal axis 270. The seat 30 also includes an annularly shaped beveled sealing surface 330 which surrounds the orifice 320 and tapers radially downward and inward toward the orifice 320 such that the sealing surface 330 is oblique to the longitudinal axis 270. The words "inward", "outward", and derivatives thereof refer to directions toward and away from, respectively, the longitudinal axis.

The needle 40 is connected to the armature 240 and is reciprocally located within the housing chamber 262 generally along the longitudinal axis 270 of the valve body 20. The needle 40 is reciprocable between a first, or open, position wherein the needle 40 is displaced from the seat 30 (as shown in FIG. 2), allowing pressurized fuel to flow downstream past the needle 40, and a second, or closed, position wherein the needle 40 is biased against the seat 30 (as shown in FIG. 1) by a biasing element (not shown), preferably a spring, precluding fuel flow past the needle 40.

The needle 40 includes a first portion 410 which has a first cross-sectional area A1 and a second portion 420 which has a second cross-sectional area A2. The second portion 420 includes a generally spherical contact face 422 (shown in FIG. 6) which sealingly engages the beveled sealing surface 330 when the needle 40 is in the closed position. However, those skilled in the art will recognize that a generally flat or planar end face 426 (shown in FIG. 2) can be located at the downstream tip of the needle 40. The end face 426 is preferably generally perpendicular to the longitudinal axis 270 of the valve body 20. A generally annular area of contact 423 provides a solid seal between the needle 40 and the seat 30 and reduces the possibility of fuel leakage past the needle 40.

Preferably, both the first and second cross-sectional areas A1, A2 are circular, although those skilled in the art will recognize that the first and second cross-sectional areas A1, A2 can be other shapes as well. This configuration reduces the mass of the needle 40 while retaining a relatively large sealing diameter of the contact face 422 so as to provide a relatively generous sealing area of the needle 40 for engagement of the contact face 422 when the needle 40 is in the closed position. The increased cross-sectional area A2 of the needle provides a larger guide surface relative to the mean needle diameter, thereby improving the wear resistance of the internal surface of the central needle guide opening 281. The improved wear resistance of the internal surface of the central needle guide opening 281 is due to reduced loading compared to that of a conventional base guide diameter which was used with prior art needles of a generally constant cross-sectional area. For example, a typical prior art needle will have a substantially continuous cylindrically shaped shaft which terminates at an end portion wherein the cross-sectional area at the top portion of the needle may be twice as much as the cross-sectional area A1 of the needle 40 shown in FIG. 1. The second cross-sectional area A2 is sized so that the second portion 420 extends through the central needle guide opening 281 with a gap of approximately 10–15 microns between the needle 40 and the plate 280.

The needle 40 is reciprocable between the closed position (shown in FIG. 1) and the open position (shown in FIG. 2). When the needle 40 is in the open position, a generally annular channel 430 extending toward the longitudinal axis 270 is formed between the contact face 422 and the sealing surface 330.

Referring to FIG. 2, the orifice plate assembly 50 is a multi-layer composite orifice plate which is constructed from at least two separate orifice plates, a top orifice plate 510 and a bottom orifice plate 520 and is located at the housing outlet 220. A spacer orifice plate 530, located between the top orifice plate 510 and the bottom orifice plate 520, is preferably used. However, the spacer orifice plate 530 can be omitted as long as a predetermined gap is maintained between a downstream face 514 of the top orifice plate 510 and an upstream face 522 of the bottom orifice plate 520.

Figure 3:
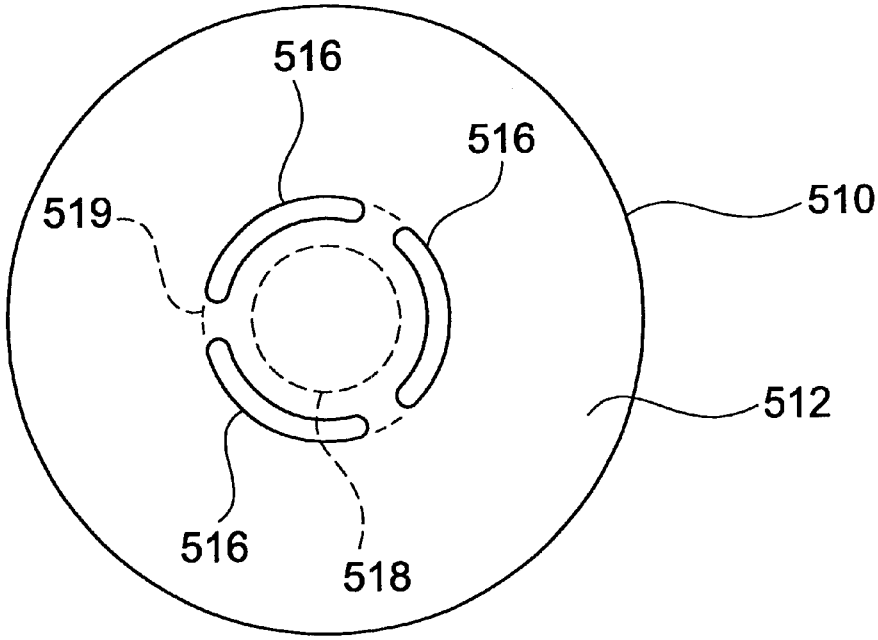
FIG. 3 is a top plan view of a top orifice plate according to the first preferred embodiment of the present invention.

A first embodiment of the orifice plate assembly 50, shown in FIG. 2, includes the top orifice plate 510 having an upstream face 512, the downstream face 514, and a plurality of generally arcuate holes or openings 516 extending through the top orifice plate 510 and radially spaced a first predetermined distance from the longitudinal axis 270. The arcuate openings 516 are preferably symmetrically spaced from the longitudinal axis 270 and approximate a circular shape as shown in FIG. 3. Preferably, three arcuate openings 516 are preferred, although those skilled in the art will recognize that more or less than three arcuate openings 516 can be used. Preferably, a relatively large total surface area of the arcuate openings 516 is preferred to reduce pressure loss through the arcuate openings 516. However, those skilled in the art will recognize that a total surface area of the arcuate openings 516 should not be so great as to degrade the strength of the top orifice plate 510. The top orifice plate 510 is preferably generally perpendicular to the longitudinal axis 270. Preferably, the plurality of arcuate openings 516 are immediately downstream and adjacent to the seat orifice 320, as shown in FIG. 2.

Figure 4:
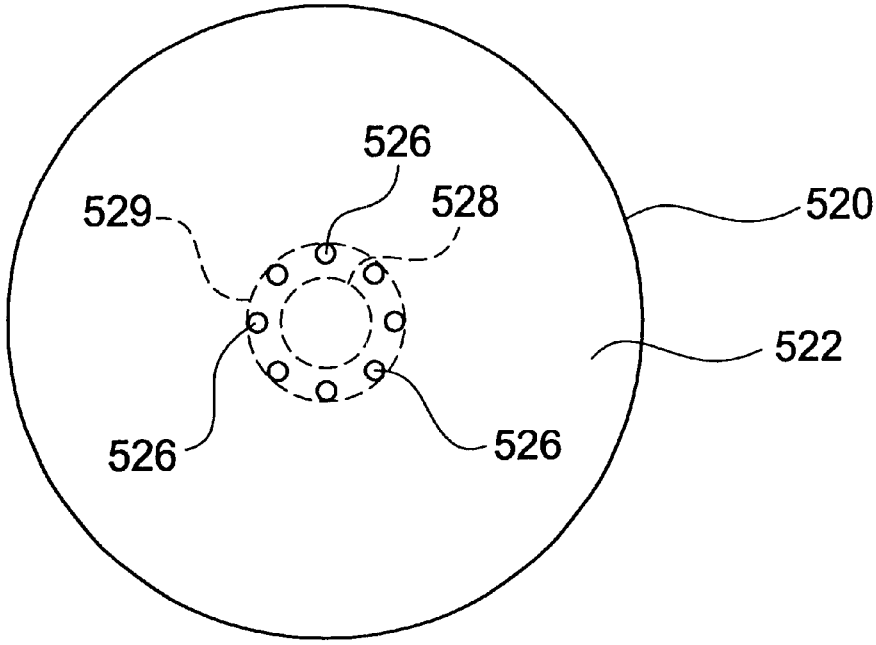
FIG. 4 is a top plan view of a bottom orifice plate of the present invention.

The bottom orifice plate 520 has the upstream face 522, a downstream face 524, and a plurality of preferably circular or polygonal metering holes or openings 526 extending through the bottom orifice plate 520 and radially spaced a second predetermined distance from the longitudinal axis 270. The openings 526 are preferably symmetrically spaced from the longitudinal axis 270 and approximate a circular shape as shown in FIG. 4. One advantage of a polygonal opening is that the corners between the sides of the opening can be finely tuned to control fuel targeting into the combustion chamber. The metering openings 526 are preferably symmetrically spaced a different distance from the longitudinal axis 270 than the arcuate openings 516 and approximate a generally circular shape as shown in FIG. 4, such that the top orifice plate arcuate openings 516 and the bottom orifice plate metering openings 526 do not overlap each other, as seen in FIG. 2.

Preferably, the bottom orifice plate openings 526 are closer to the longitudinal axis 270 than the top orifice plate openings 516, although those skilled in the art will recognize that the bottom orifice plate openings 526 can be farther from the longitudinal axis 270 than the top orifice plate openings 516. Preferably, eight metering openings 526 are preferred, although those skilled in the art will recognize that more or less than eight metering openings 526 can be used. However, it is important to note that the number of arcuate openings 516 cannot equal the number of metering openings 526. The bottom orifice plate 520 is preferably generally perpendicular to the longitudinal axis 270.

Figure 5:
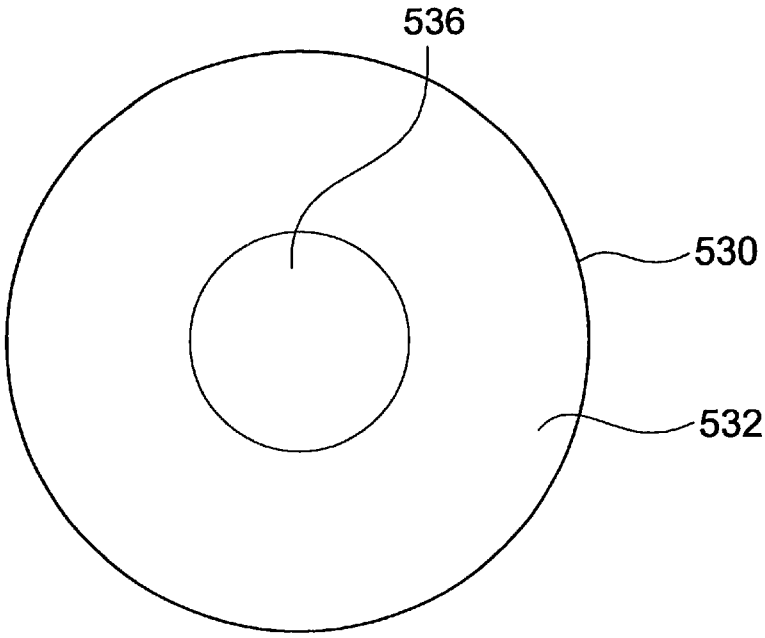
FIG. 5 is a top plan view of a spacer orifice plate of the present invention.

The spacer orifice plate 530, shown in FIG. 5, between the top and bottom orifice plates 510, 520, is used to control vertical spacing between the top and bottom orifice plates 510, 520 so that an optimized radial fuel velocity component can be generated and maintained. As shown in FIGS. 2 and 5, the spacer orifice plate 530 includes an upstream face 532, a downstream face 534, and a generally channel or circular opening 536 which extends radially from the longitudinal axis 270. The opening 536 is in fluid communication with each of the plurality of arcuate openings 516 and the plurality of metering openings 526 so that the fuel can flow from the arcuate openings 516, through the circular opening 536, and through the metering openings 526.

A virtual extension 340 of the seat 30 can be projected onto the upstream face 512 of the top orifice plate 510 so as to intercept the upstream face 512 of the top orifice plate 510 at a point "A", shown in FIG. 2. The virtual extension 340 can be further projected onto the upstream face 522 of the bottom orifice plate 520 so as to intercept the upstream face 522 of the bottom orifice plate 520 at a point "B", shown in FIG. 2. Referring to FIG. 3, the arcuate openings 516 are sufficiently far from the longitudinal axis 270 such that a virtual circle 518 formed by the virtual extension 340 of the seat 30 onto the upstream face 512 of the top orifice plate 510 at "A" has a smaller diameter than a virtual circle 519 drawn around an outer perimeter of the arcuate openings 516. Similarly, referring to FIG. 4, the metering openings 526 are sufficiently far from the longitudinal axis 270 such that a virtual circle 528 formed by the virtual extension 340 of the seat 30 onto the upstream face 522 of the bottom orifice plate 520 at "B" has a smaller diameter than a virtual circle 529 drawn around an outer perimeter of the metering openings 526. This ensures that the flow of fuel between the arcuate openings 516 and the metering openings 526 when the needle 40 is in the open position directs the fuel onto the upstream face 522 of the bottom orifice plate 520 to provide a transverse flow of the fuel across the upstream face 522 of the bottom orifice plate 520 to the metering openings 526 prior to the fuel entering the metering openings 526.

The top orifice plate 510 eliminates any effect of the movement of the needle 40 relative to the seat 30 on the spray definition and reduces or eliminates flow instability of the fuel prior to entering the bottom orifice plate openings 526. The bottom orifice plate 520 is the primary metering orifice plate through which the fuel passes immediately prior to entering the combustion chamber. The space between the downstream face 514 of the top orifice plate 510 and the upstream face 522 of the bottom orifice plate 520 is preferably between 75 microns and 300 microns.

The use of the three distinct orifice plates, the top orifice plate 510, the bottom orifice plate 520, and the spacer orifice plate 530 allows for a significant level of flexibility in manufacturing the metering assembly 10. Different configurations of the top, bottom, and spacer plates 510, 520, 530 are removable from and replaceable with other top, bottom, and spacer plates (not shown) and can be mixed and matched to create optimum flow paths for turbulence enhanced atomization and fuel targeting. Fuel flow characteristics can be tailored to the application required without any changes in the product fabrication process.

Additionally, although not shown, a fourth orifice plate, similar spacer orifice plate 530 can be inserted between the upstream face 512 of the top orifice plate 510 and the downstream end of the valve seat 30. Such a configuration can be used if the orifice 320 is not large enough to provide desired radial spacing of the openings 516 in the top orifice plate 510 from the longitudinal axis 270.

Preferably, the plates are fabricated by the type of process that is consistent with the geometric requirements for that portion of the fuel path. Preferably, the top orifice plate 510 and the spacer orifice plate 530 can easily be fabricated by an inexpensive process such as punching or etching.

Preferably, the more critical metering openings 526 in the bottom orifice plate 520 would be processed by a precision punching or precision laser machine process to provide the precise dimensions required for required targeting into the combustion chamber.

Although three orifice plates 510, 520, 530 are preferred, those skilled in the art will recognize that the spacer orifice plate 530 can be combined with one of the top or bottom orifice plates 510, 520 using manufacturing processes which are well known to those skilled in the art, resulting in only two orifice plates. Additionally, the orifice plates 510, 520, 530 can be dimpled together to generate a variety of spray patterns. The fuel flow rate is controlled by the location and the size of the metering openings 526 in the bottom orifice plate 520. The metering openings 526 are distributed so that the turbulence intensity is equal and maximized for each individual metering opening 526 in the bottom orifice plate 520.

Preferably, the orifice plates 510, 520, 530 are constructed from a metallic material, and more preferably from stainless steel, although those skilled in the art will recognize that at least one of the orifice plates 510, 520, 530 can be constructed from other suitable materials.

The operation of the fuel metering assembly 10 is as follows. Pressurized fuel flow into the metering assembly 10 is provided by a fuel pump (not shown). The pressurized fuel enters the metering assembly 10 and passes through a fuel filter (not shown) to the armature 240, and to the housing chamber 262. The fuel flows through the housing chamber 262, the fuel flow openings 282 in the guide 280 to the interface between the contact face 422 and the sealing surface 330. In the closed position (shown in FIG. 1), the needle 40 is biased against the seat 30 so that the contact face 422 sealingly engages the sealing surface 330, preventing flow of fuel through the composite orifice plate assembly 50.

In the open position, shown in FIG. 2, a solenoid or other actuating device, (not shown) reciprocates the needle 40 to an open position, removing the contact face 422 of the needle 40 from the sealing surface 330 of the seat 30 and forming the generally annular channel 430. Pressurized fuel within the housing chamber 262 flows past the generally annular channel 430 formed by the needle 40 and the seat 30 and impinges on the upstream face 512 of the top orifice plate 510. The fuel then flows through the plurality of arcuate openings 516 into the open space 536 in the spacer orifice plate 530 between the top and bottom orifice plates 510, 520. The fuel then accelerates along the upstream face 522 of the bottom orifice plate 520 in a transverse direction relative to the metering openings 526. The fuel then flows across the metering openings 526 where the fuel is atomized as it passes through the metering openings 526 into the combustion chamber. Fuel flows into the space bounded by the downstream face 514 of the top orifice plate 510 and the upstream face 522 of the bottom orifice plate 520. Additional turbulence is generated to enhance the fuel atomization as the fuel passes through the metering openings 526.

Figure 7:
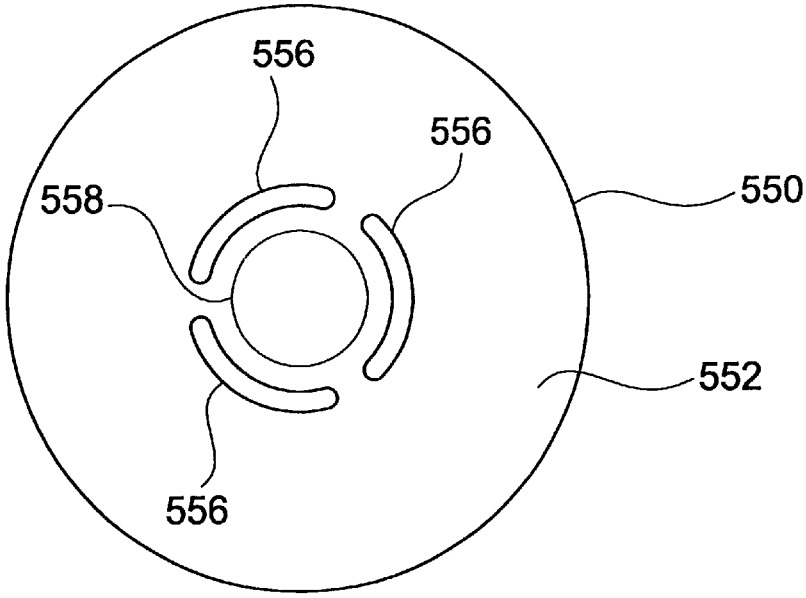
FIG. 7 is a top plan view of a top orifice plate according to the second preferred embodiment of the present invention.
Figure 6:
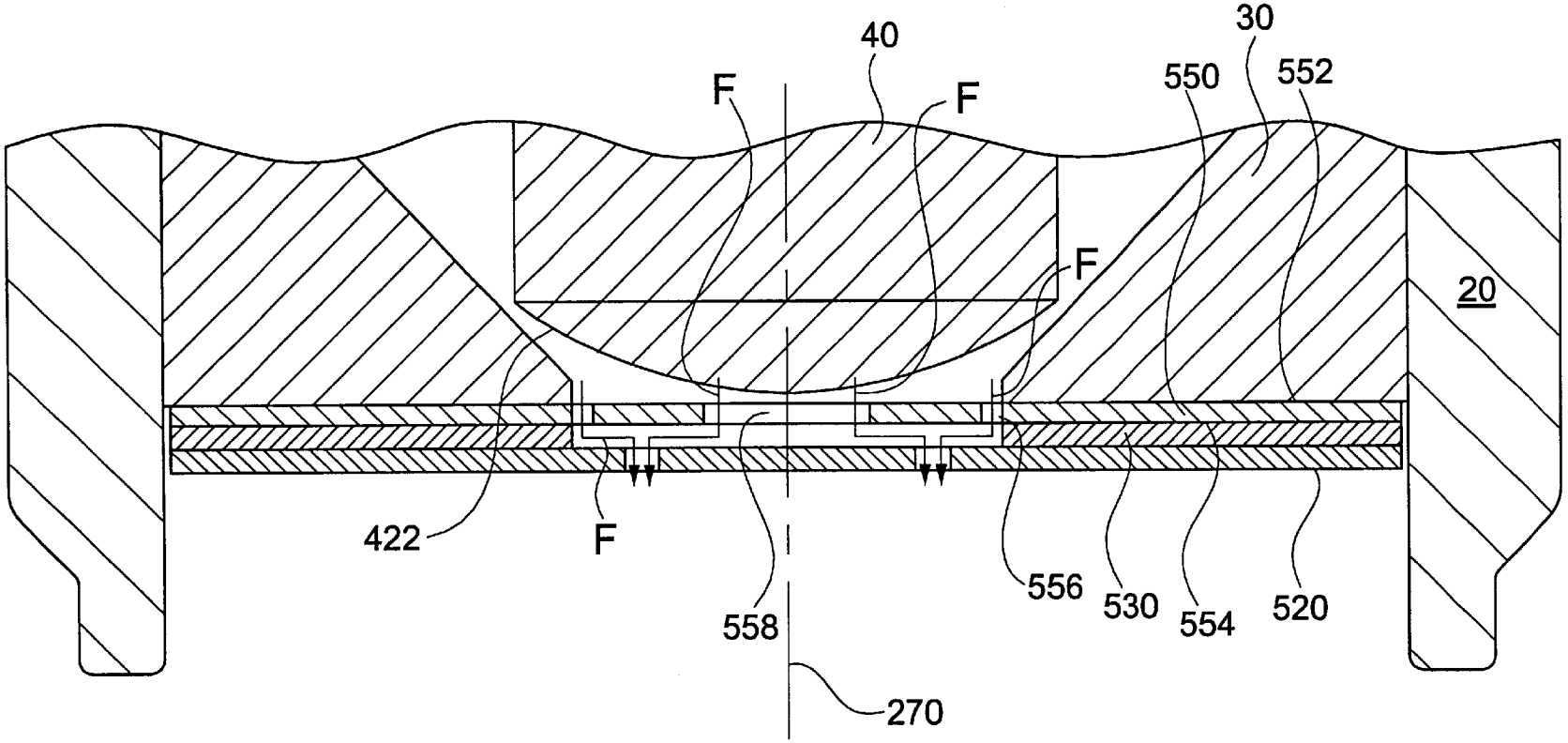
FIG. 6 is an enlarged view of the discharge end of the fuel injector incorporating a multiple orifice plate configuration according to a second embodiment of the present invention.

An alternate embodiment includes a modified top orifice plate 550 shown in FIGS. 6 and 7. Although similar to the top orifice plate 510 in FIGS. 1, 2 and 3, the top orifice plate 550 includes an upstream face 552, a downstream face 554, and a plurality of arcuate openings 556. The top orifice plate 550, however, is modified to include an additional central hole or opening 558 which extends through the top orifice plate 550 and extends radially from the longitudinal axis 270. The central opening 558 is fluidly connected to the plurality of metering openings 526 by way of the central opening 536 in the spacer plate 530. The central opening 558 increases the opening surface area in the top orifice plate 550 and reduces fuel pressure loss between the top and bottom orifice plates 550, 520. Additionally, the central opening 558 generates and controls impinging fuel flow streams "F" as shown in FIG. 6. These impinging streams "F" generate additional turbulence in the fuel to promote fuel atomization.

Preferably, in each of the embodiments described above, the seat 30 is constructed from stainless steel and the needle 40 is constructed from stainless steel. However, those skilled in the art will recognize that the seat 30 and the needle 40 can be constructed of other, suitable materials.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. A fuel injector comprising:

a housing having an inlet, an outlet and a longitudinal axis extending therethrough;

a seat disposed proximate to the outlet, the seat including a sealing surface and a passage extending therethrough;

a needle being reciprocally located within the housing along the longitudinal axis between a first position wherein the needle is displaced from the seat, allowing fuel flow past the needle, and a second position wherein the needle is biased against the seat, precluding fuel flow past the needle; and a multi-layer orifice plate assembly located at the housing outlet, the orifice plate assembly including:

a first orifice plate having at least a plurality of first openings, each first opening being generally arcuate and spaced about the longitudinal axis at a first predetermined radial distance from the longitudinal axis; and a second orifice plate separate from the first orifice plate such that the first plate is located between the seat and a second orifice plate, the second orifice plate having a plurality of second openings extending therethrough, each second opening being spaced a second predetermined radial distance from the longitudinal axis, the plurality of first openings and the plurality of second openings being fluidly connected by at least one channel.

2. The fuel injector according to claim 1, wherein the second predetermined radial distance is less than the first predetermined radial distance.

3. The fuel injector according to claim 1, wherein the first orifice plate further includes a central opening extending therethrough along the longitudinal axis, the central opening being fluidly connected to the plurality of second openings.

4. The fuel injector according to claim 1, further including a third orifice plate located between the first orifice plate and the second orifice plate, the third orifice plate including a third orifice plate central opening extending therethrough along the longitudinal axis, the third orifice plate central opening fluidly connecting the plurality of first orifice plate openings and the plurality of second orifice plate openings.

5. The fuel injector according to claim 4, wherein at least one of the first orifice plate, the second orifice plate and the third orifice plate are removable from and replaceable with at least a fourth orifice plate.

6. The fuel injector according to claim 1, wherein the second orifice plate openings are non-circular.

7. The fuel injector according to claim 1, wherein the needle has a generally spherical end face.

8. The fuel injector according to claim 7, wherein a plane of each of the first and second orifice plates is generally perpendicular to the longitudinal axis.

9. The fuel injector according to claim 1, wherein at least one of the first and second orifice plates is constructed from a metal.

10. A fuel injector comprising:

a housing having an inlet, an outlet and a longitudinal axis extending therethrough;

a seat disposed proximate the outlet, the seat including a sealing surface and a passage extending therethrough;

a needle being reciprocally located within the housing along the longitudinal axis between a first position wherein the needle is displaced from the seat, allowing fuel flow past the needle, and a second position wherein the needle is biased against the seat precluding fuel flow past the needle; and a multi-layer orifice plate assembly located at the housing outlet, the orifice plate assembly including:

a first orifice plate having at least a plurality of first openings, each first opening being generally arcuate and spaced about the longitudinal axis at a first predetermined radial distance from the longitudinal axis;

a second orifice plate separate from the first orifice plate such that the first plate is located between the seat and a second orifice plate, the second orifice plate having a plurality of second openings extending therethrough, each second opening being spaced a second predetermined radial distance from the longitudinal axis, the second predetermined radial distance being less than the first predetermined radial distance; and a third orifice plate located between the first orifice plate and the second orifice plate, the third orifice plate being separate from the first and second orifice plates, the third orifice plate including a third orifice plate central opening extending therethrough along the longitudinal axis, the third orifice plate central opening fluidly connecting the plurality of first and second openings.

11. The fuel injector according to claim 10, wherein the first orifice plate further includes a central opening extending therethrough along the longitudinal axis, the central opening being fluidly connected to the plurality of second openings.

12. The fuel injector according to claim 10, wherein at least one of the first orifice plate, the second orifice plate and the third orifice plate are removable from and replaceable with at least a fourth orifice plate.

13. The fuel injector according to claim 10, wherein the second predetermined radial distance is less than the first predetermined radial distance.

14. The fuel injector according to claim 10, wherein the second orifice plate openings are non-circular.

15. The fuel injector according to claim 10, wherein a plane of each of the first and second orifice plates is generally perpendicular to the longitudinal axis.

16. The fuel injector according to claim 10, wherein at least one of the first, second, and third orifice plates is constructed from a metal.

17. A method of accelerating a velocity of fuel through a fuel injector having a longitudinal axis and a multi-layer orifice plate assembly disposed proximate a valve seat, the method comprising:

directing the fuel through openings in a top orifice plate disposed between the valve seat and a bottom orifice plate, the openings in the top orifice plate being generally arcuate with respect to the longitudinal axis;

directing the fuel into a space between the top orifice plate and a bottom orifice plate; and directing the fuel through openings in the bottom orifice plate, the openings in the bottom orifice plate being closer to the longitudinal axis than the openings in the top orifice plate.

18. The method according to claim 17, further comprising the step of providing a spacer orifice plate between the top orifice plate and the bottom orifice plate, the spacer orifice plate having an opening in fluid communication with the openings in the top orifice plate and the openings in the bottom orifice plate.

19. The method according to claim 17, wherein the openings in the bottom orifice plate define a generally radial pattern about the longitudinal axis.

20. A fuel injector comprising:

a housing having an inlet, an outlet and a longitudinal axis extending therethrough;

a seat disposed proximate to the outlet, the seat including a sealing surface and a passage extending therethrough;

a needle being reciprocally located within the housing along the longitudinal axis between a first position wherein the needle is displaced from the seat, allowing fuel flow past the needle, and a second position wherein the needle is biased against the seat, precluding fuel flow past the needle;

a multi-layer orifice plate assembly located at the housing outlet, the orifice plate assembly including:

a first orifice plate having at least a plurality of first openings extending therethrough; and a second orifice plate separate from the first orifice plate, the second orifice plate having a plurality of second openings extending therethrough each being spaced a second predetermined radial distance from the longitudinal axis, the plurality of first openings and the plurality of second openings being fluidly connected by at least one channel; and a virtual extension sealing surface forming a virtual circle on the first and second plates such that the plurality of the first openings are outside the virtual circle on the first plate and the plurality of the second openings are outside the virtual circle on the second plate.

21. A fuel injector comprising:

a housing having an inlet, an outlet and a longitudinal axis extending therethrough;

a seat disposed proximate the outlet, the seat including a sealing surface and a passage extending therethrough;

a needle being reciprocally located within the housing along the longitudinal axis between a first position wherein the needle is displaced from the seat, allowing fuel flow past the needle, and a second position wherein the needle is biased against the seat precluding flow past the needle;

a multi-layer orifice plate assembly located at the housing outlet, the orifice plate assembly including:

a first orifice plate having at least a plurality of first openings extending therethrough, the plurality of first openings each being spaced a first predetermined radial distance from the longitudinal axis;

a second orifice plate separate from the first orifice plate, the second orifice plate having a plurality of second openings extending therethrough each being spaced a second predetermined radial distance from the longitudinal axis, the second predetermined radial distance being less than the first predetermined radial distance, the plurality of first openings and the plurality of second openings being fluidly connected by at least one channel; and a third orifice plate located between the first orifice plate and the second orifice plate, the third orifice plate being separate from the first and second orifice plates, the third orifice plate including a third orifice plate central opening extending therethrough along the longitudinal axis, the third orifice plate central opening fluidly connecting the plurality of first and second openings; and a virtual extension of the sealing surface forming a virtual circle on the first and second plates such that the plurality of the first openings are outside the virtual circle on the first plate and the plurality of the second openings are outside the virtual circle on the second plate.

22. The fuel injector of claim 21, wherein the arcuate openings are located outside the virtual circle and the central opening is located within the virtual circle.

* * * * *